US007464437B2

(12) United States Patent
Song

(10) Patent No.: US 7,464,437 B2
(45) Date of Patent: Dec. 16, 2008

(54) DOOR CLOSER

(76) Inventor: Jang-Woo Song, 105-1902, Bando Boravill Apt., Seonghyeonmaeul, Jukjeon-Dong, Yongin-Si 449-540 (KR)

( * ) Notice: Subject to any disclaimer, the term of this patent is extended or adjusted under 35 U.S.C. 154(b) by 288 days.

(21) Appl. No.: 10/595,673

(22) PCT Filed: Nov. 9, 2004

(86) PCT No.: PCT/KR2004/002885

§ 371 (c)(1),
(2), (4) Date: May 3, 2006

(87) PCT Pub. No.: WO2005/047631

PCT Pub. Date: May 26, 2005

(65) Prior Publication Data

US 2007/0039130 A1 Feb. 22, 2007

(30) Foreign Application Priority Data

Nov. 12, 2003 (KR) ..... 20-2003-0035431 U
Apr. 8, 2004 (KR) ..... 20-2004-0009740 U

(51) Int. Cl.
*E05F 1/10* (2006.01)

(52) U.S. Cl. ..... 16/79; 16/51; 16/66

(58) Field of Classification Search ..... 16/79, 16/76, 72, 84, 58, 66, 52, 51, 57
See application file for complete search history.

(56) References Cited

U.S. PATENT DOCUMENTS 1,643,932 A * 9/1927 Teich ..... 16/51
1,833,121 A * 11/1931 Norton ..... 16/51
1,970,008 A * 8/1934 Larson ..... 16/58
2,723,416 A * 11/1955 Schlage ..... 16/52
2,770,003 A * 11/1956 Comey et al. ..... 16/52
3,078,499 A * 2/1963 Gray et al. ..... 16/52
3,078,501 A * 2/1963 Thorman ..... 16/66
3,161,908 A * 12/1964 Walach ..... 16/52
3,887,961 A * 6/1975 Saajos ..... 16/56
4,139,182 A * 2/1979 Nagase et al. ..... 267/120
4,648,151 A 3/1987 Whaley
5,657,511 A * 8/1997 Lan ..... 16/51
6,317,922 B1 11/2001 Kondratuk
6,871,381 B1 * 3/2005 Luca ..... 16/52

FOREIGN PATENT DOCUMENTS

JP 56-127270 9/1981
KR 20-0298397 12/2002

* cited by examiner

*Primary Examiner*—Chuck Y. Mah
(74) *Attorney, Agent, or Firm*—IPLA P.A.; James E. Bame

(57) ABSTRACT

The apparatus for closing the door slowly and automatically can directly get the door closed by the piston rod without passing through a gear, so that the energy loss is little, and a small amount of air is contained in the hydraulic oil in order for the piston and the piston rod to be moved to the left and right hand side. The closing speed of the door can be adjustable by turning a speed adjustment bolt and for the installation, it is very easy to install the present invention since the function of the invention works with a force adjustment by turning the force adjustment nut when the invention is fixed to the door and doorframe.

5 Claims, 14 Drawing Sheets

【Fig.1】
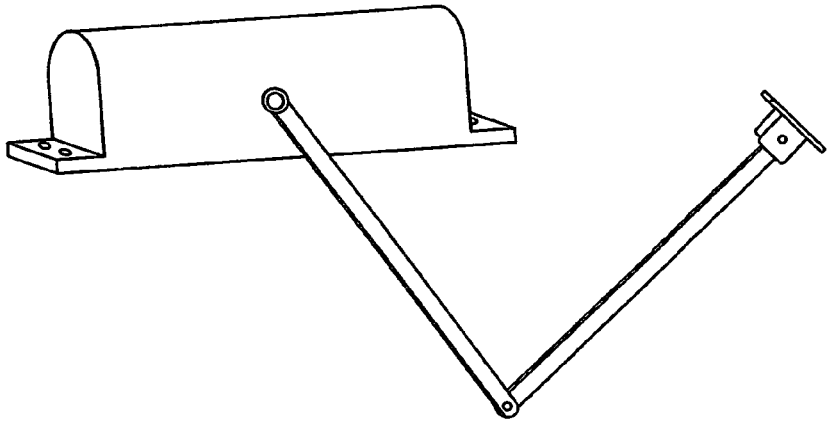
【Fig.2】
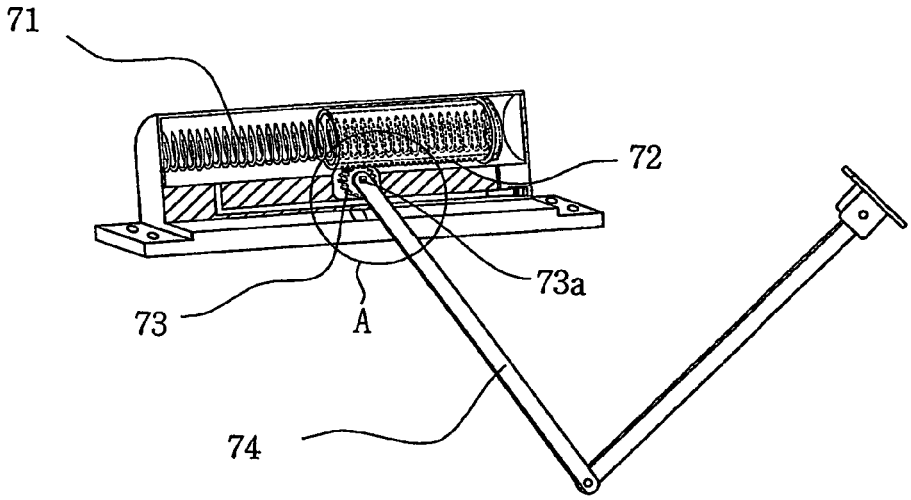

【Fig.3】
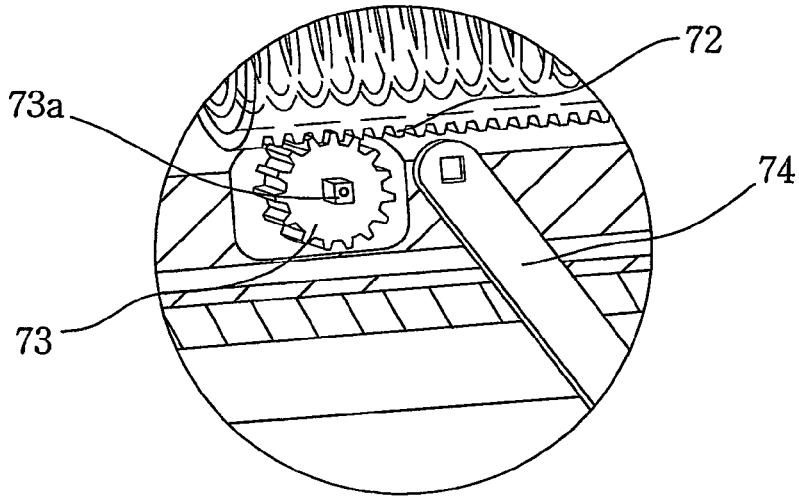
【Fig.4】
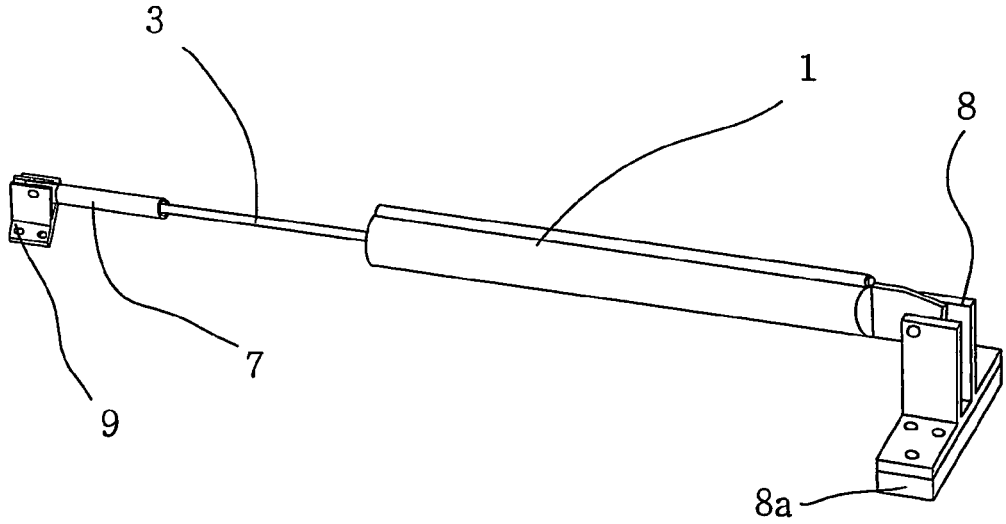

【Fig.5】
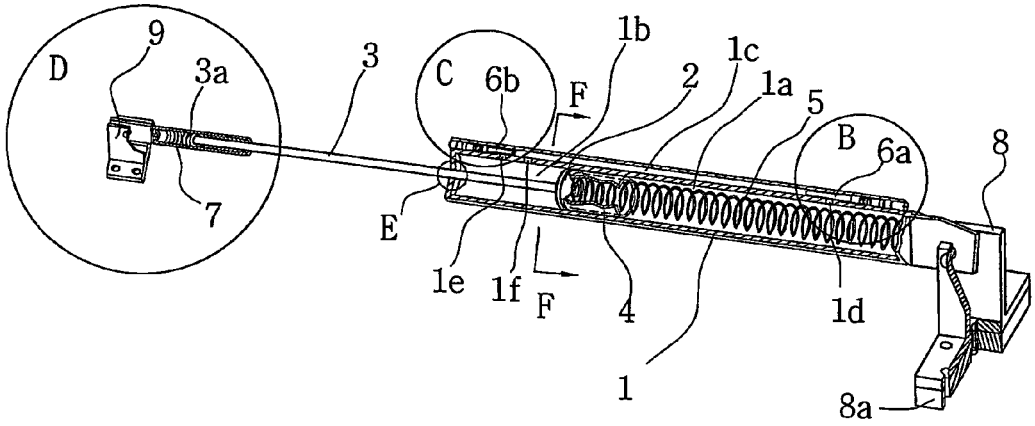
【Fig.6】
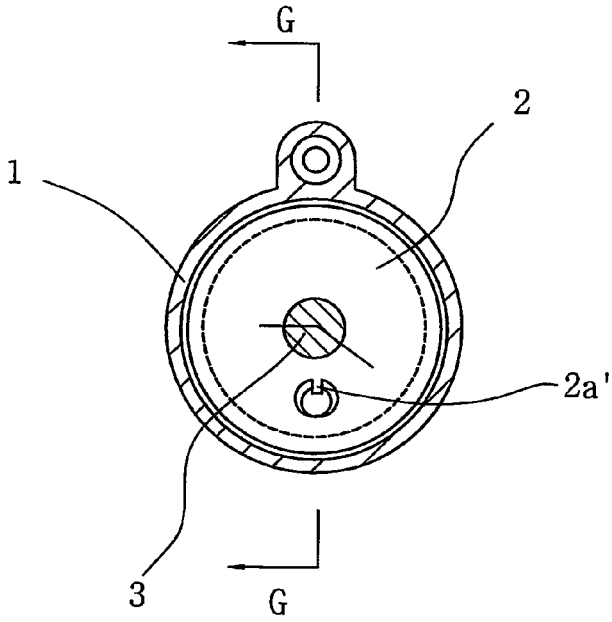

【Fig.7】
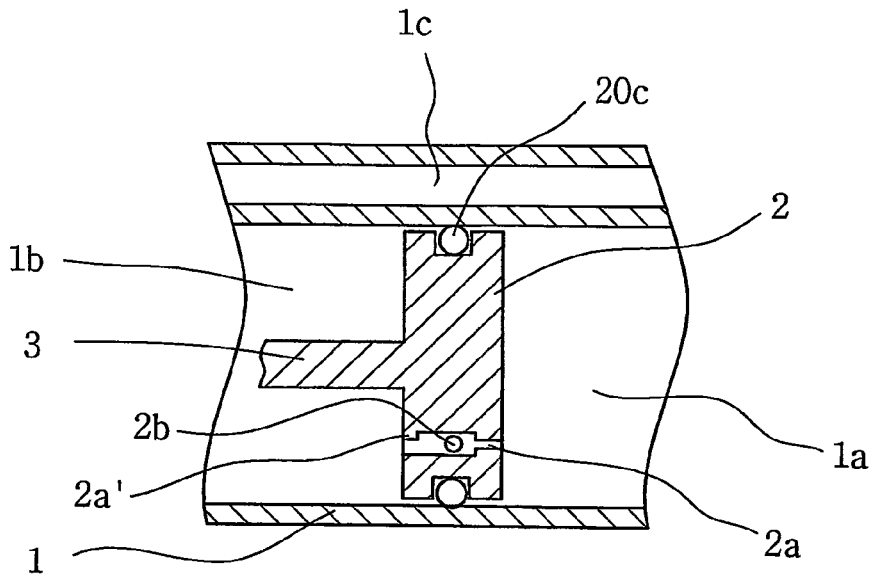
【Fig.8】
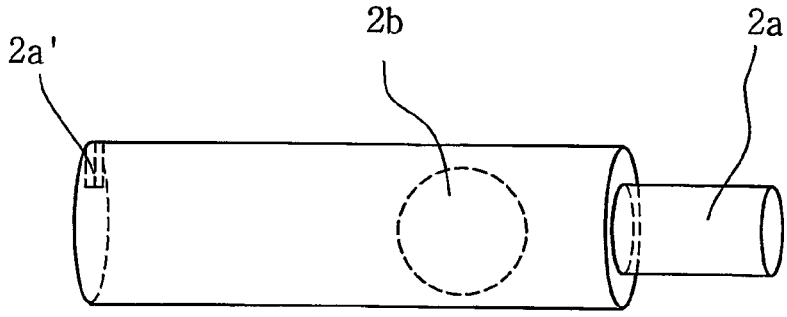

【Fig.9】
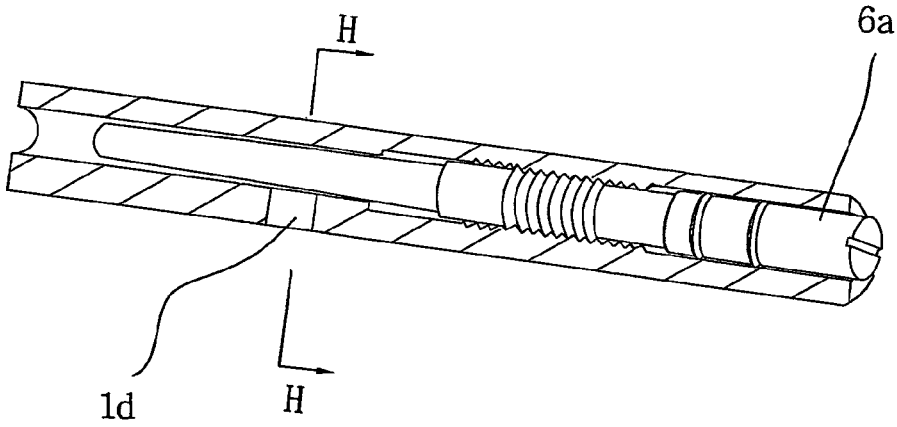
【Fig.10】
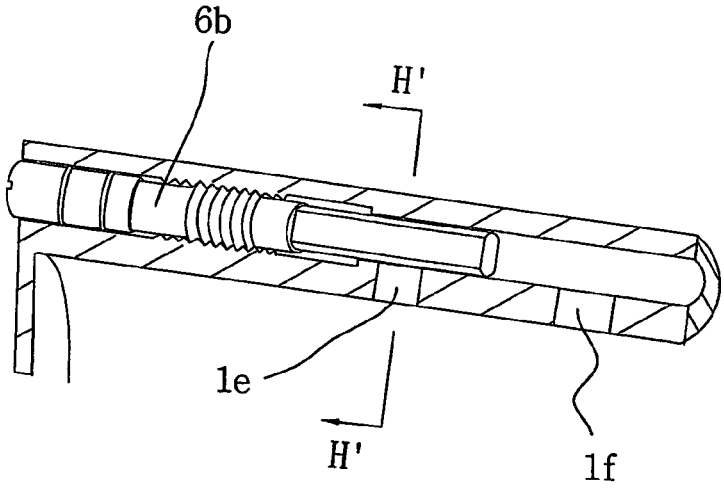

【Fig.11】
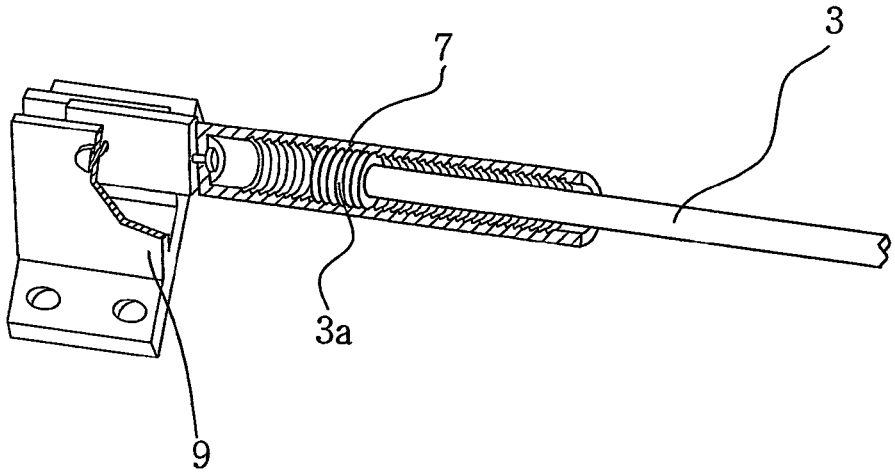
【Fig.12】
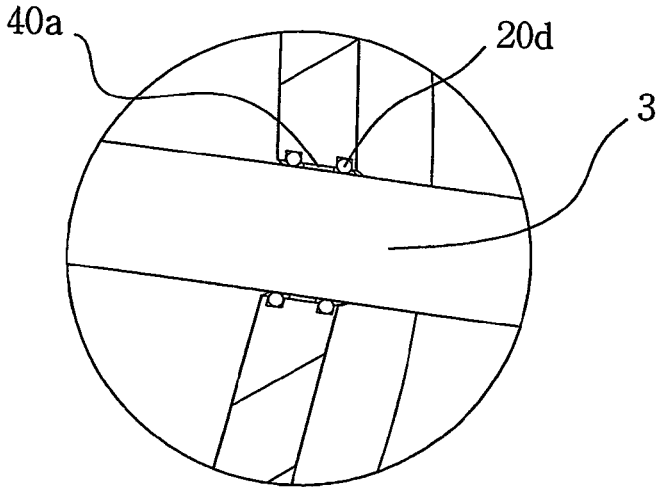

【Fig.13】
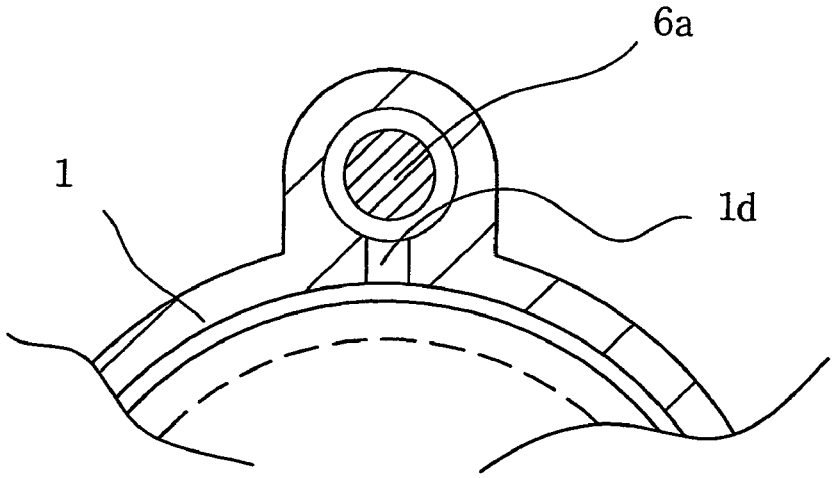
【Fig.14】
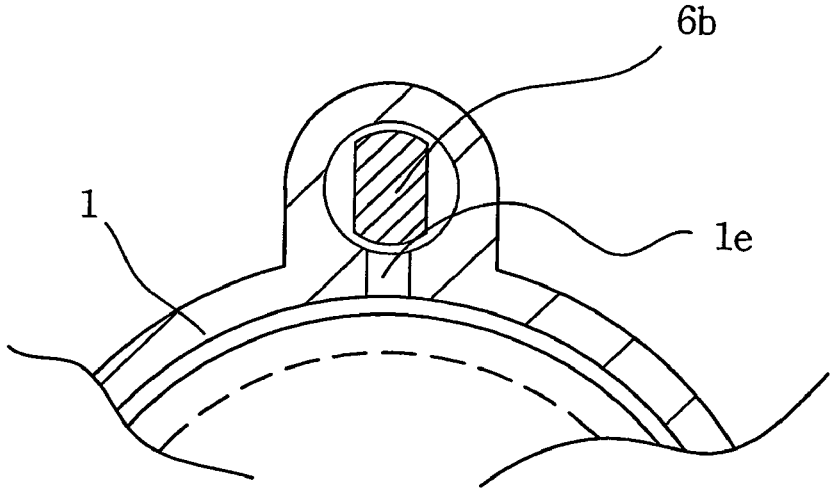

【Fig.15】
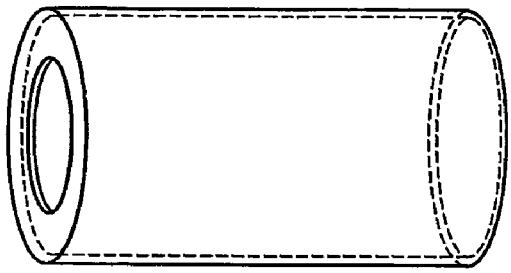
【Fig.16】
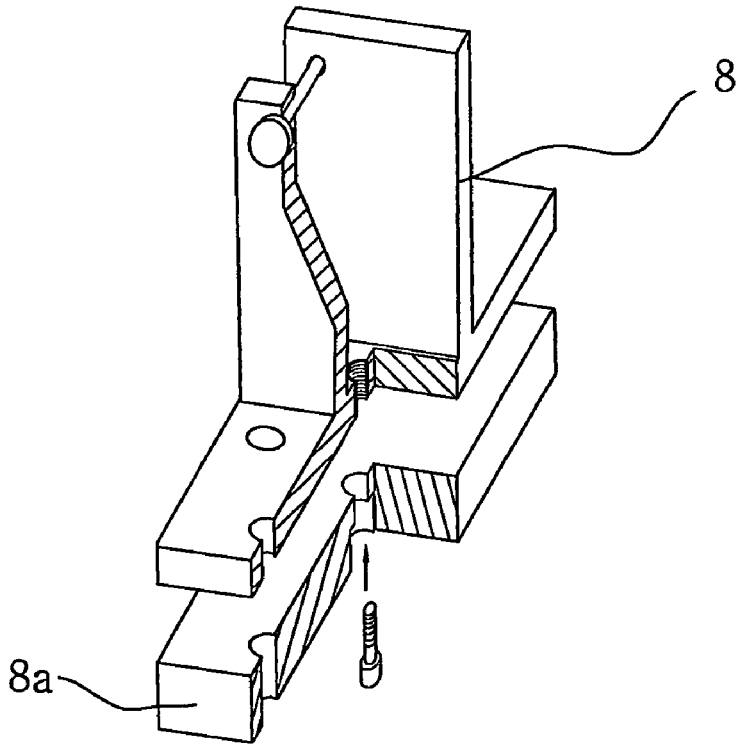

【Fig.17】
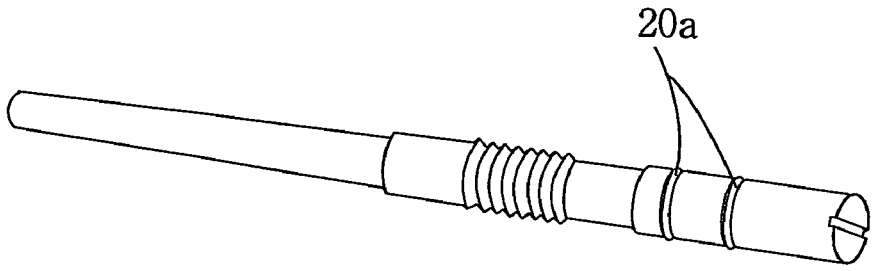
【Fig.18】
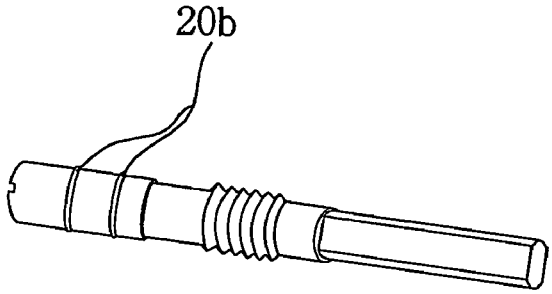

【Fig.19】
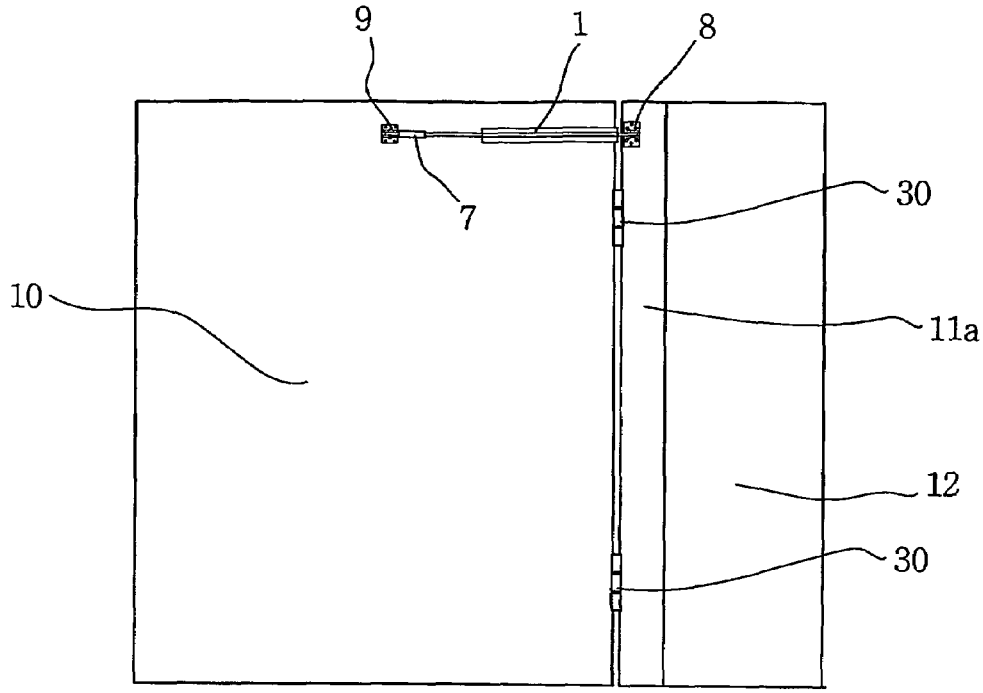
【Fig.20】
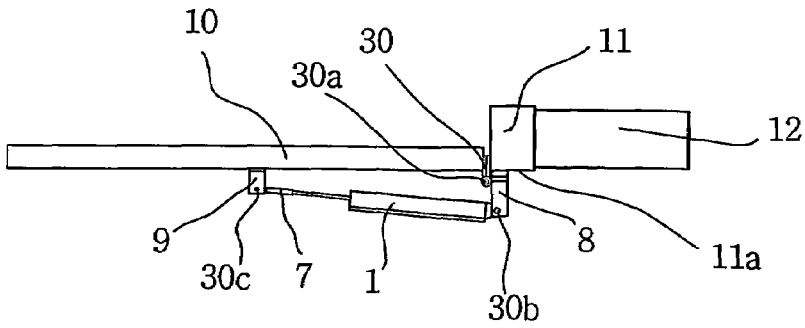

【Fig.21】
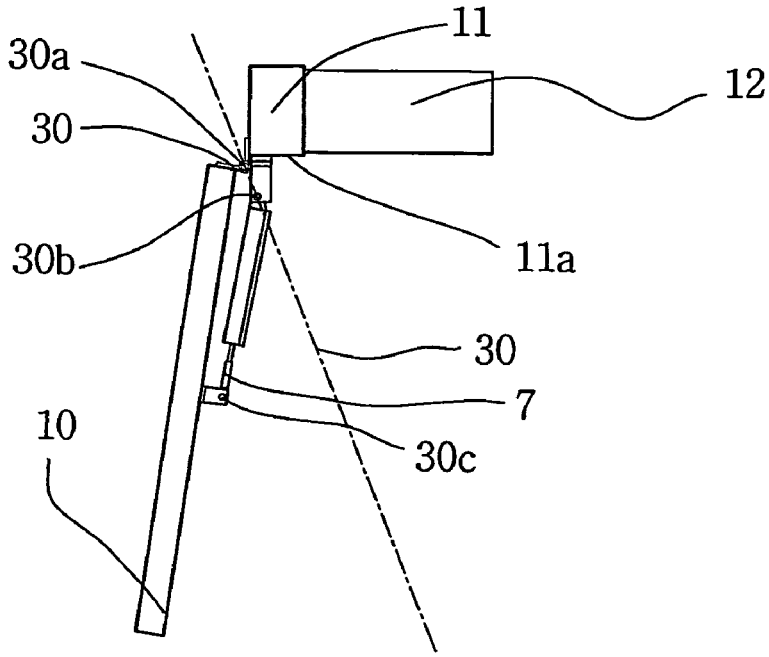
【Fig.22】
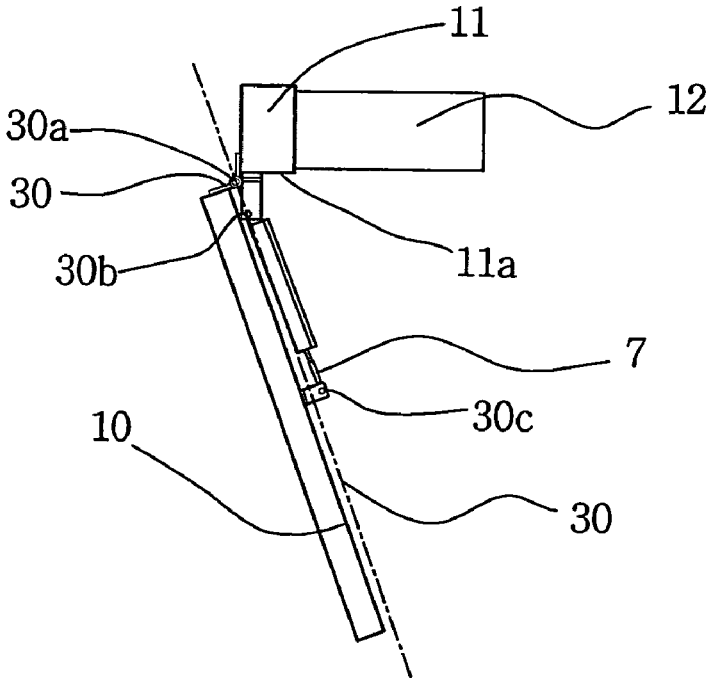

【Fig.23】
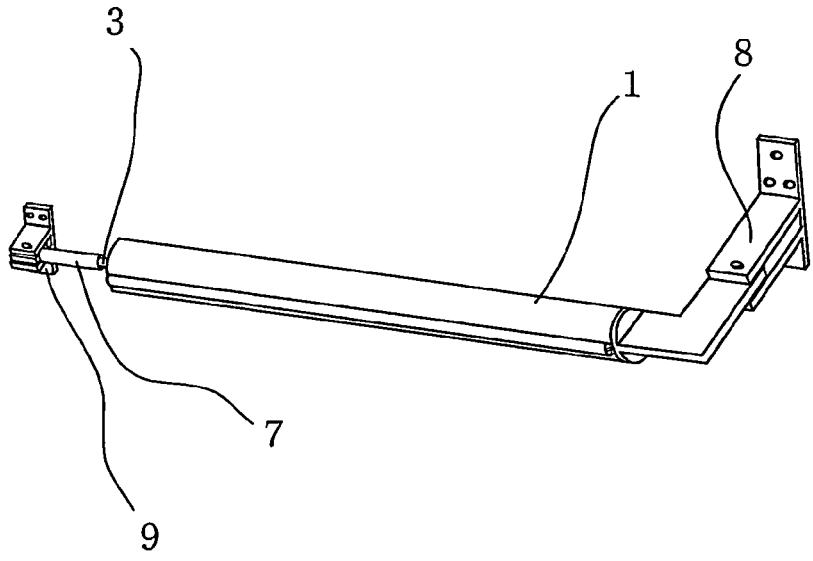
【Fig.24】
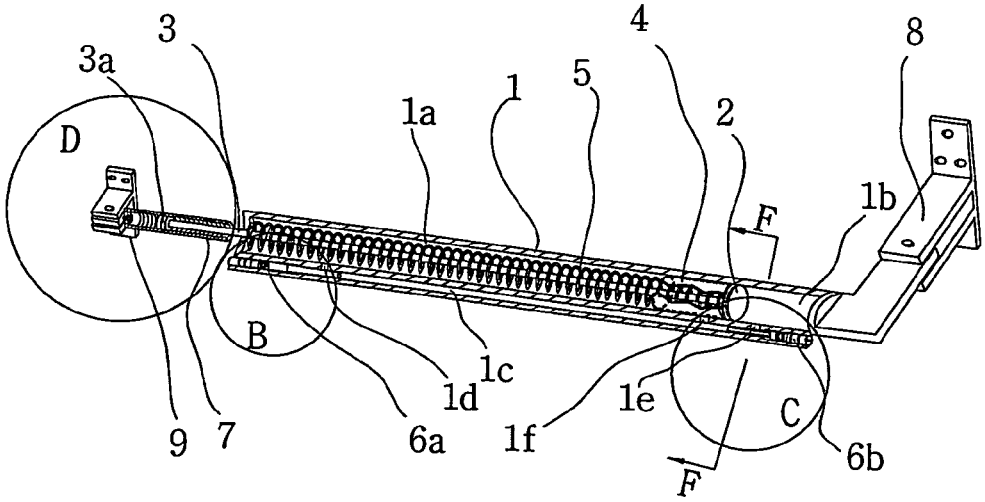

【Fig.25】
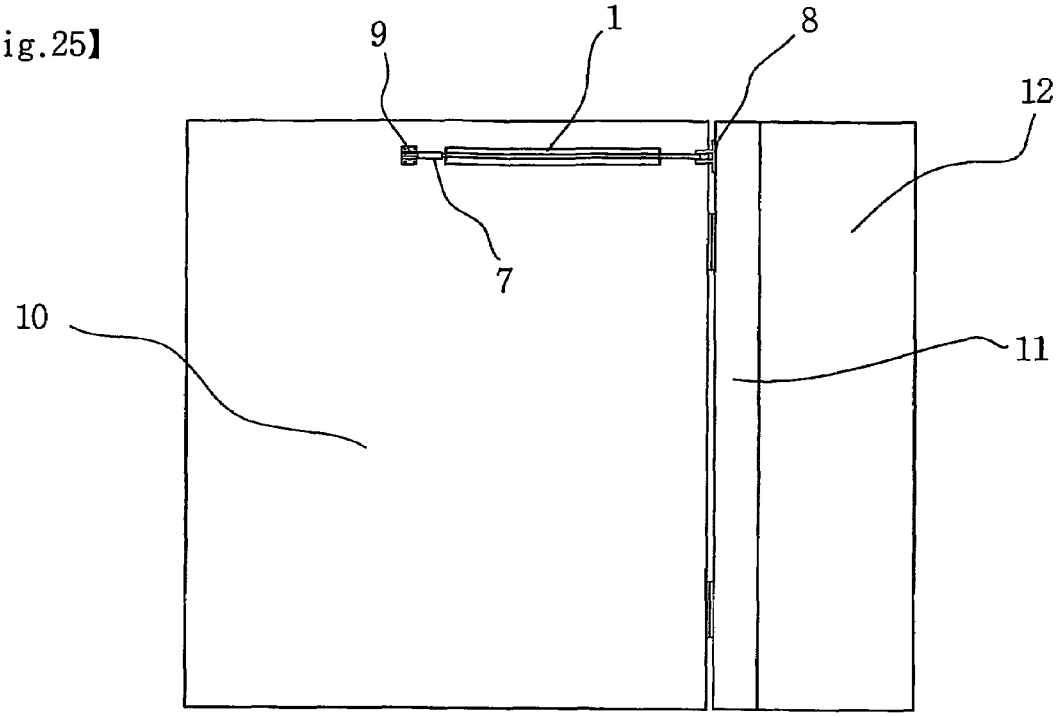
【Fig.26】
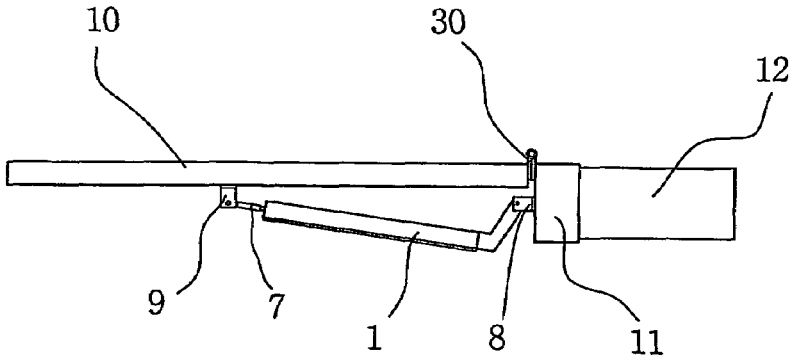

【Fig.27】
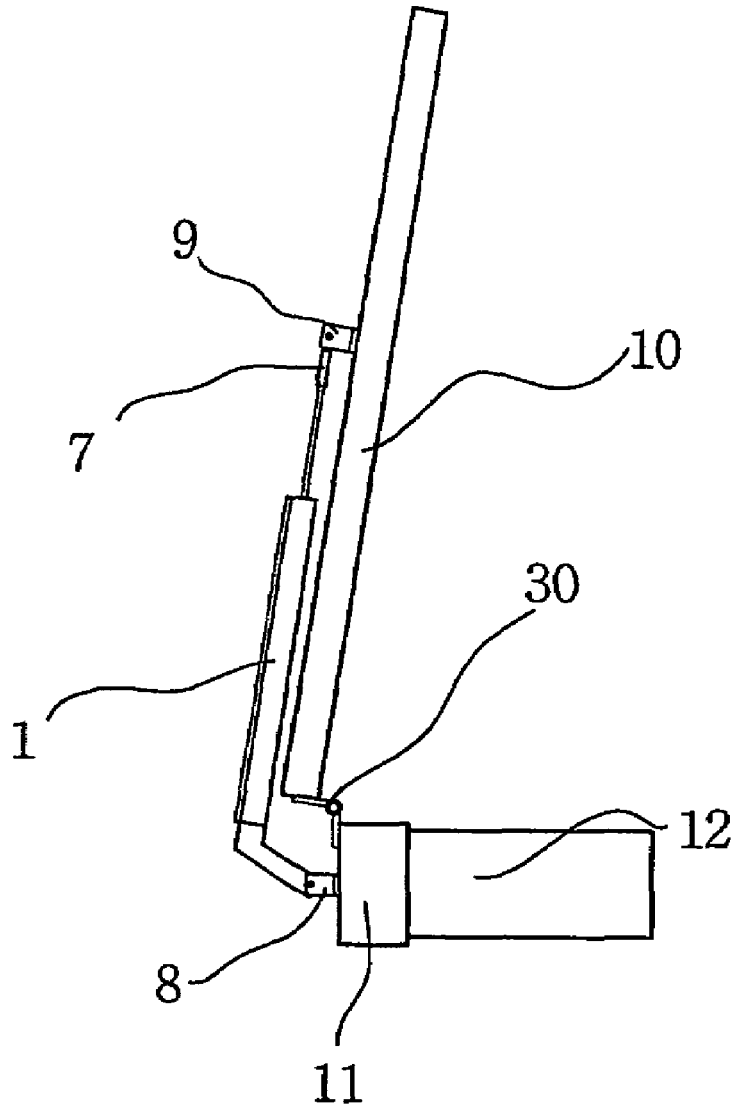

DOOR CLOSER

TECHNICAL FIELD

The present invention relates to a door closer for closing automatically slowly various kinds of opening and closing doors.

BACKGROUND ART

Conventionally, in order for the door to be closed automatically, as shown in FIG. 2, a spring and a gear are installed inside the cylindrical-shaped body, which is filled with hydraulic oil. The restoring force of the spring transferred to the gear a 72, the gear b 73, and the link 74 allows the door to be closed slowly. In the conventional product, the restoring force of the spring is transferred through a gear and a link in order for the door to be closed so that a power loss is incurred and a very strong compression spring is required, and the structure is complicated and heavy because of the built-in gear, and the outer appearance may be spoiled due to the link attached outside. In addition, in order to adjust the opening and closing force of the door after installation, as in FIG. 2 and the link 74 is disassembled from the catch rod formed on the gear b 73, and the assembling angle of the link 74 to the catch rod 73*a* is changed to compress the spring 71, and the link is reinstalled for a force adjustment, so that it is very inconvenient to adjust the force, and a higher power is needed for the force adjustment. It must be installed by the specialist for the adjustment of the mounting position to the door and the doorframe and the length of the link. However, according to the present invention, the restoring force of the spring is directly transferred to the piston rod for closing the door without necessity of the gear. A small amount of air is contained in hydraulic oil to enable the piston rod to move forward and backward. A speed adjustment bolt is mounted to the edge of both sides of the cylinder for the door to be closed quickly or slowly. Also, a force adjustment nut, which is essentially required for installation of the present invention to the door and the doorframe, is assembled to one end of the piston rod to adjust opening and closing force when the door is opened and closed.

DISCLOSURE OF INVENTION

The present invention has been made in order to solve the above problems occurring in the art, and it is an object of the invention to provide a door closer. In the conventional product, the restoring force of the spring is transferred to a gear and a link to close the door, so that it generates much power loss and a very strong compression spring is required, and the structure is complicated and heavy because of the built-in gear, and the appearance is spoiled due to the link attached outside. In addition, installation is very hard so that a specialist should install it. It is not appropriate to install it to the wooden or lightweight door because of easy damage of mounting portion. It is very inconvenient because it must be disassembled for a force adjustment after installation. It should be reinstalled to the door after the force adjustment.

The present invention enables the restoring force of the spring to be directly transferred to the piston rod and to close the door skipping the gear, and a small amount of air is contained in hydraulic oil to enable the piston rod to move forward and backward. In addition, a speed adjustment bolt is mounted to the edge of both sides of the cylinder for adjusting the closing speed of the door. Also a force adjustment nut which is essentially required when the invention is installed to the door and doorframe is assembled to one end of the piston rod to adjust the closing force of the door.

In the present invention, the restoring force of the spring is directly transferred to the piston rod without through a gear to thereby allow the door to be closed so that a power loss is little, and it is light and a simple structure, thereby having a nice appearance. Also the closing speed of the door is adjusted simply by turning the speed adjustment bolt, and for the installation, it only requires turning the force adjustment nut after mounting the invention to the door and the doorframe, so that even a beginner can install it because installation is so easy. The adjustment of opening and closing force of the door is done by turning only the force adjustment nut so that it is easy to adjust the force. In addition, it can be applied to the weak or light door because the mounting portion of the door and the doorframe is not damaged due to the weak spring used.

BRIEF DESCRIPTION OF DRAWINGS

Further objects and advantages of the invention can be more fully understood from the following detailed description taken in conjunction with the accompanying drawings, in which:

FIG. 1 is a perspective view of a conventional door closer;

FIG. 2 shows the inside structure of the conventional door closer;

FIG. 3 is an enlarged and exploded view of the portion A shown in FIG. 2;

FIG. 4 is a perspective view of a door closure according to the present invention;

FIG. 5 shows the internal structure of the door closer according to the present invention;

FIG. 6 shows a cross section taken along the line F-F in FIG. 5;

FIG. 7 is a cross sectional view taken along the line G-G in FIG. 6;

FIG. 8 is an enlarged perspective view of the portion marked by reference numeral 2*a* in FIG. 7;

FIG. 9 is an enlarged view of the portion B in FIG. 5;

FIG. 10 is an enlarged view of the portion C in FIG. 5;

FIG. 11 is an enlarged view of the portion D of FIG. 5;

FIG. 12 is an enlarged view of the portion E of FIG. 5;

FIG. 13 is a cross sectional view taken along the line H-H in FIG. 9;

FIG. 14 is a cross sectional view taken along the line 10;

FIG. 15 is a detailed view of the portion marked by reference numeral 4 in FIG. 5;

FIG. 16 is an enlarged exploded view of the portions marked by reference numerals 8 and 8*a* in FIG. 5;

FIG. 17 is an enlarged view of the portion marked by reference numeral 6*a* in FIG. 5;

FIG. 18 is an enlarged view of the portion marked by reference numeral 6*b* in FIG. 5;

FIG. 19 shows an installation example of the door closer of the invention where the door closer is installed to a door (an elevational view);

FIG. 20 shows an installation example of the door closer of the invention (a top plan view);

FIG. 21 shows an installation example of the door closer of the invention where the door is opened (a top plan view 1);

FIG. 22 shows an installation example of the door closer of the invention where the door is opened (a top plan view 2):

FIG. 23 is a perspective view of the present invention for installation to the closing side of the door;

FIG. 24 shows the internal structure of the present invention for installation to the closing side of the door;

FIG. 25 is an installation example view of the present invention for installation to the closing side of the door (an elevational view);

FIG. 26 is an installation example view 1 of the present invention for installation to the closing side of the door (a top plan view); and FIG. 27 is an installation example view 2 of the present invention for installation to the closing side of the door (a top plan view).

BEST MODE FOR CARRYING OUT THE INVENTION

The preferred embodiments of the present invention will be hereafter described in detail with reference to the accompanying drawings.

In the present invention, a subsidiary plate 9*a* with a subsidiary pin 9*b* is assembled to a door mounting device 9 installed at a door 10, and a force adjustment nut 7, which is rotatable to right or left side, is assembled to the subsidiary plate 9*a* so that it can change the position of a piston rod 3 to the door 10 or to a doorframe 11, and a cylinder 1 is assembled to a doorframe mounting device 8 installed at the door frame 11, a surface of the cylinder 1 being provided with hemicylindrical shaped protrusions, in which an oil-hole is formed and a speed adjustment bolt is assembled at the end thereof, extending linearly in the longitudinal direction, a piston 2 which forms a hole 2*a*, and an catch rod 2*a*', and a spring 5 is mounted in the cylinder 1 and hydraulic oil containing a little amounts of air is filled in the cylinder 1, the piston rod 3 is extending from an inner side to an outer side of the cylinder 1, one end of the piston rod 3 being provided with the piston 2 and the other end thereof being provided with male screw 3*a* in which minor diameter of an external thread is greater than a diameter of the piston rod 3 so that the piston rod 3 can be moved in the force adjustment nut 7, and the door mounting device 9 including the force adjustment nut 7, subsidiary plate 9*a* and subsidiary pin 9*b*, and the doorframe mounting device 8 including the cylinder 1, the piston rod 3 and the male screw 3*a*, can be assembled and separated from each other by the force adjustment nut 7 provided at the door mounting device 9, and the male screw 3*a* is an additional supporter. 20*a*, 20*b*, 20*c*, and 20*d* are oil seals, and 40*a* is a sliding bearing. The reference numerals 1*c*, 1*d*, 1*e*, and 1*f* are oil holes, and 2*b* is a ball, and 30*a*, 30*b*, and 30*c* are rotation centers. The reference numeral 30 is a connection line of rotation center.

In the present apparatus comprising the above elements, the piston 2 and the piston rod 3 in FIG. 5 are pushed to the right side to compress the spring 5 as the door in FIG. 20 is opened. At this time, the ball 2*b* in the hole in FIG. 7 is pushed to the left side, thereby leading hydraulic oil in the cylinder chamber 1*a* to flow quickly out to the cylinder chamber 1*b*. The ball 2*b* is blocked by the catch rod 2*a*' so that it can not escape outside and the hydraulic oil flows quickly out around the ball, thereby allowing the door to open quickly. On this occasion, when the hydraulic oil flowing out of the cylinder chamber 1*a* flows in the cylinder chamber 1*b*, a little air contained in the cylinder is compressed to adjust the inflow flux as much as the volume of the moving piston rod 3.

A spring guide 4 is assembled between the piston 2 and the spring 5 for the spring to be evenly compressed and expanded, thereby preventing damage of the inner wall of cylinder while the spring 5 compresses and expands. In FIG. 22, if the door 10 is open at more than a certain angle it remains opened by the spring 5 without holding the door.

That is, when the door is open at more than a certain angle, as in the FIG. 22, the rotation center 30*c* is at the side of the wall 12 in reference to the connection line of centerline 30, which is a connection line of a centerline 30*a* and a centerline 30*b*. Then, a pushing force of the spring 5 makes the door opened more and keeps the door opened. When the door is open at less than a certain angle, as in the FIG. 21, the rotation center 30*c* is at an opposite side of wall 12 in reference to the connection line of rotation center 30, then the force of spring 4 makes the door closed. That is, if the door 10 is closed a little when it is opened or if the door 10 is released when it is opened at less than a certain angle, a restoration force of the spring 4 pushes the piston 2 and the piston rod 3 to the left hand side to close the door 10. On this case, in order for the door to be closed, the ball 2*b* in the hole 2*a* in FIGS. 7 and 8 is pushed to the right hand side by flow of the hydraulic oil and the hole is closed, thereby leading the hydraulic oil to slowly flow in the cylinder chamber 1*a* from the cylinder chamber 1*b* passing through oil hole 1*e*, 1*f*, 1*c*, and 1*d*.

At this time, a little amount of air contained in the cylinder expands as much as the volume of the moving piston rod, and also the oil hole 1*d* is increased or decreased by turning the speed adjustment bolt 6*a*, thereby adjusting a flux of the hydraulic oil and closing speed of the door. The oil hole 1*e* is increased or decreased by turning the fine speed adjustment bolt 6*b*, thereby adjusting the last closing speed of the door.

That is, when the door opens and begins to get closed, the closing speed of the door is adjusted according to the size of oil hole by the speed adjustment bolt 6*a* until the piston 2 reaches to the position of the oil hole 1*f*, but after passing the oil hole 1*f* the last closing speed of the door is adjusted according to the size of oil hole 1*e* by the fine speed adjustment bolt 6*b*. In FIGS. 5 and 11, if the force adjustment nut 7 is turned to the left or right hand side, the female screw formed inside the force adjustment nut 7 pushes the male screw 3*a* formed on the one side end of the piston rod to outside or pull it to inside, thereby making the closing force of the door to be strong or weak.

In terms of an installation, when the male screw 3*a* is completely pulled to the doorframe mounting device 9, the present invention fixed to the door 10 and front face of the doorframe and the male screw is pushed to the cylinder side by turning the force adjustment nut 7, thereby enabling the closing force of the door to be strong and the installation to be easy. On the other hand, in FIG. 20, the additional supporter 8*a* may or may not be installed underneath the doorframe mounting device 8 according to the degree of protrusion in height of the front face of doorframe, to which the doorframe mounting device 8 is attached in reference to the rotation center 30*a* of the hinge 30. That is, when it is protruded high, the rotation center 30*b* becomes high so that the additional supporter 8*a* is not installed, and when it is protruded low, the rotation center 30*b* becomes low, and the additional supporter 8*a* is installed to raise the rotation center 30*b*. Therefore, if it is installed, the rotation center 30*b* is raised and the force is improved, but the moving distance of the piston rod is prolonged when the door opens and closes, so that the entire length of the present invention is prolonged and unreasonable force is applied to the wall, and therefore a use of proper selection is required.

As describe above, the present invention is installed to the opening side of the door, so that the door is closed by the force pushing toward the door. In case where it is installed to the closing side of the door, FIGS. 23 and 24 of the same principle can be used. In this case, in FIG. 5, the internal structural view of the invention which is installed to the opening side of the door, mounting position of the spring 5, the spring guide 4, the speed adjustment bolt 6*a*, and the oil hole is changed to the left from the right hand side in reference to the piston 2, and mounting position of the fine speed adjustment bolt 6*b* and the oil hole 1*e*, 1*f* is changed to the right from the left hand side, and also the piston is attached to the piston rod 3 in 180 degree rotated. In terms of the installation, the door closer of the invention is fixed to the door 10 and the doorframe 11 after disposing the male screw 3*a* to the end of right hand side of the force adjustment nut 7, and then the male screw 3*a* is pulled to the door mounting device 9 by turning the force adjustment nut 7, so that the closing force of the door becomes strong. In addition, in the perspective view of the invention (FIG. 23) and the internal structural view (FIG. 24) in case of an installation to the door closing side, the door is closed by the force pulling toward the door.

INDUSTRIAL APPLICABILITY

The present invention can be used to most of the opening and closing doors for automatic closing of the door. The cylinder 1 in the present invention can be manufactured by aluminum casting, but it can be produced inexpensively in terms of production cost by aluminum extrusion, and the piston rod 3 is finished with a thin dense chromium plate to prevent from getting rust as well as to improve the surface roughness of the piston rod, thereby preventing a leakage of the hydraulic oil when the piston rod slides forward and backward. In addition, the additional supporter 8*a* may or may not be installed underneath the doorframe mounting device 8 according to the degree of protrusion of the front face of doorframe 11*a* in reference to the rotation center. That is, if installed, the force is improved but the moving distance of the piston rod is prolonged during opening and closing the door, and thus entire length of the present invention is prolonged and unreasonable force is applied to the wall, so that it requires a proper selection and use. However, if the front face of the doorframe 11*a* is protruded too high in reference to the rotation center of the hinge, a doorframe mounting device in low height needs to be used. Also, a spring guide 4 made of a type of plastic material is installed inside the cylinder 1 in order to prevent the inner wall surface of the cylinder from damage by the spring 5 when the spring expands and compresses and to help the spring to evenly expands and compresses. If the amount of air contained in the hydraulic oil is more than a proper amount, a noise generates when the piston 2 and the piston rod 3 moves to the right and left hand sides and moving speed of the piston rod to the right and left sides is irregular, and if the air is contained less than the proper amount, the piston and the piston rod don't move to the right and left hand side, and therefore, a little proper amount of air needs to be contained to just move the piston and the piston rod to the right and left hand side. For installation, the door mounting device 9 is fixed to the door 10 and the doorframe mounting device 8 is fixed to the front face of doorframe 11*a* using a nail or a screw.

Then, the opening and closing force is set properly by turning the force adjustment nut 7, and closing speed is adjusted by turning the speed adjustment bolt, and the installation is finished and the present invention can be used. In addition, the present invention can be applied to the opening and closing doors from a big to a small door.

In particular, the present invention has a nice appearance so that it is suitable to the place where the beauty is regarded as an important factor, also the present invention is suitable for the door, which is weak and the mounting area is easily damaged. Also, even a beginner can easily install the present invention to the door because it does not require a skill for installation.

What is claimed is:

1. A door closer which is fabricated in a hydraulic or air cylinder shape in its body and being installed to a door (10) or a doorframe (11), wherein a subsidiary plate (9*a*) with a subsidiary pin (9*b*) is assembled to a door mounting device (9) installed at the door (10), and a rotatable force adjustment nut (7) is assembled to the subsidiary plate (9*a*) so that it can change the position of a piston rod (3) to the door (10) or to the doorframe (11);

wherein a cylinder (1) is assembled to a doorframe mounting device (8) installed at the doorframe (11), a surface of the cylinder (1) being hemi-cylindrical, in which an oil-hole is formed and a speed adjustment bolt is assembled at end thereof, extending linearly in the longitudinal direction along a piston (2), and a spring (5) is mounted in the cylinder (1) and hydraulic oil containing a little amounts of air is filled in the cylinder (1), the piston rod (3) is extending from an inner side to an outer side of the cylinder (1), one end of the piston rod (3) being provided with the piston (2) and the other end thereof being provided with male screw (3*a*) in which minor diameter of an external thread is greater than a diameter of the piston rod (3); and wherein the door mounting device (9) including the force adjustment nut (7), subsidiary plate (9*a*) and subsidiary pin (9*b*), and the doorframe mounting device (8) including the cylinder (1), the piston rod (3) and the male screw (3*a*), can be assembled and separated from each other by the force adjustment nut (7) provided at the door mounting device (9), and the male screw (3*a*) provided at the one end of the piston rod (3).

2. The door closer of claim 1, wherein an additional supporter (8*a*) of a rectangular shape is provided at lower surface of the doorframe mounting device (8), a longitudinal and transverse length thereof being identical with those of the lower surface of the doorframe mounting device (8), and holes corresponding to screw holes formed at lower surface of the doorframe mounting device (8) is formed at the additional supporter 8*a* so as to fix the doorframe mounting device (8) to the doorframe (11), with forming an additional central hole in the supporter (8*a*) for assembling with the doorframe mounting device (8).

3. The door closer of claim 2, wherein the additional supporter (8*a*) is made of materials selected from plastic group.

4. The door closer of claim 1, wherein the piston (2) is provided with a hole (2*a*) and is connected to one end of the piston rod (3), an catch rod (2*a*') being formed at the hole (2*a*) and a ball (2*b*) is received therein, and the male screw (3*a*) is formed or attached to other end of the piston rod (3), the minor diameter of an external thread being greater than the diameter of the piston rod (3).

5. The door closer of claim 1, wherein the force adjustment nut (7) is exposed to outside to make it easy to mount and control force, an female screw being formed at inside of the force adjustment nut (7), the minor diameter of the internal thread being greater than the diameter of the piston rod (3), and the force adjustment nut (7) has a cylindrical shape with a big central through-hole extending therethrough.

* * * * *